US008651026B2

(12) United States Patent
Maeyama et al.

(10) Patent No.: US 8,651,026 B2
(45) Date of Patent: Feb. 18, 2014

(54) GUIDEWAY TYPE VEHICLE

(75) Inventors: Hiroyuki Maeyama, Mihara (JP); Yoshinori Mitsui, Mihara (JP); Kousuke Katahira, Kawasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 96 days.

(21) Appl. No.: 13/148,397

(22) PCT Filed: Jul. 28, 2009

(86) PCT No.: PCT/JP2009/063714
§ 371 (c)(1),
(2), (4) Date: Sep. 15, 2011

(87) PCT Pub. No.: WO2010/095288
PCT Pub. Date: Aug. 26, 2010

(65) Prior Publication Data

US 2011/0315044 A1 Dec. 29, 2011

(30) Foreign Application Priority Data

Feb. 20, 2009 (JP) ..... 2009-037911

(51) Int. Cl.
*B61F 5/10* (2006.01)
*B61F 5/24* (2006.01)

(52) U.S. Cl.
USPC ..... 105/453; 105/199.2; 105/215.2

(58) Field of Classification Search
USPC ..... 105/453, 215.2, 199.1, 199.2; 280/5, 280/514, 124.16, 6.159, 6.157, 5.514
See application file for complete search history.

(56) References Cited

FOREIGN PATENT DOCUMENTS

| | | |
|---|---|---|
| JP | S47-51366 | 12/1972 |
| JP | H06-56034 | 3/1994 |
| JP | H09-315297 | 12/1997 |
| JP | 2000-280900 | 10/2000 |
| JP | 2006-62512 | 3/2006 |

OTHER PUBLICATIONS

PCT, International Preliminary Report on Patentability and Written Opinion, Sep. 13, 2011.
Korean Patent Office, "Decision for Grant of Patent for KR 10-2011-7018937", Sep. 2, 2013.

*Primary Examiner* — Mark Le
(74) *Attorney, Agent, or Firm* — Manabu Kanesaka; Kenneth M. Berner; Benjamin J. Hauptman

(57) ABSTRACT

A vehicle includes a vehicle body, a bolster spring, a bogie supporting the vehicle body via the bolster spring and a vehicle height adjusting mechanism. The vehicle height adjustment mechanism includes an integrating device, a measuring device and an elastic force adjusting device. The integrating device integrates a first relative displacement amount at a first position between the vehicle body and the bogie and a second relative displacement amount at a second position between the vehicle body and the bogie. The measuring device measures an integrated value of the first relative displacement amount and the second relative displacement amount. The elastic force adjusting device adjusts elastic force of the bolster spring based on the integrated value so as to adjust a relative displacement amount between the vehicle body and the bogie.

8 Claims, 6 Drawing Sheets

GUIDEWAY TYPE VEHICLE

RELATED APPLICATIONS

The present application is National Phase of International Application No. PCT/JP2009/063714 filed Jul. 28, 2009, and claims priority from, Japanese Application No. 2009-037911, filed Feb. 20, 2009, the disclosure of which is hereby incorporated by reference herein in its entirety.

BACKGROUND OF THE INVENTION

1. Field of the Invention

The present invention relates to a guideway type vehicle having a vehicle body and a bogie supporting the vehicle via a bolster spring, such as a guideway type vehicle with rubber tires, in which the height adjustment thereof is made easy by performing a high-sensitive measurement of the height of the vehicle body which changes in response to the change of the vehicle body weight.

2. Description of the Related Art

A new transportation system as a medium-capacity transportation using rubber tires traveling on a special guideway such as a new transit system and MRT, has become popular in recent years. This transportation system is usually fully automated. In some cases, the transportation system is equipped with guide wheels being guided on a guideway.

In this transit system, the vehicle such as a train uses an air spring as a bolster spring. The bogie supports the vehicle body via the air spring and thus the height of the vehicle body changes in response to the weight change of the vehicle body (change of the number of passengers). To keep the floor level of the vehicle constant, a height adjusting mechanism is adopted.

The height adjustment mechanism is explained in reference to FIG. 5 and FIG. 6. In FIG. 5 and FIG. 6, a vehicle 100 of the new transit system has a bogie 104 mounted under a vehicle body 102 via an air spring. Each of the bogies has one or two air springs 106 mounted in the same position as an axle 108 in a longitudinal direction of the vehicle body and symmetrically in a width direction of the vehicle. An example of the present invention illustrates a case with one air spring.

The bogie 104 comprises an axle housing 111 arranged in the width direction of the vehicle, the axle 108 housed in the axle housing 111, rubber tires arranged on both sides of the axle 108, an axle frame 112 fixed to the axle housing to support the axle housing 111, and a guide frame 118 mounted on the axle frame 112 and supporting guide wheels 114 and 116 on an edge side of the vehicle 104 in the width direction. The vehicle 100 travels on a guideway T by the guide wheels 114 and 116 being guided by a guide rail not shown in the drawings.

As illustrated in FIG. 6, a suspension frame 120 protruding downward is fixed to the vehicle body 102 and four parallel links 122 and 124 are supported pivotally on the suspension frame 120 by one end thereof. A base part 121 is integral with the suspension frame 120 and fixed under the vehicle body. The axle frame 112 is fixed to the bogie side. The air spring 106 is installed between the base part 121 and the axle frame 112.

The parallel links 122 and 124 are pivotally supported on the axle frame 112 by the other end thereof. The axle 108 is supported by a parallel link mechanism 126 formed by the parallel links 122 and 124 such that the axle 108 can move in a parallel manner in the vertical direction. In this manner, the height fluctuation of the air spring 106 is tolerated. A propeller shaft 109 is connected to the axle 108 so as to transmit the rotation of a drive motor to the rubber tires 110 via an input shaft, a hypoid gear, deferential gear and the axle 108.

A compressed-air tank 128 as a supply source of compressed air, a compressed-air supply pipe 130 for supplying the compressed air from the tank 128 to the air spring 106, and a leveling valve 132 installed in the supply pipe 130 are provided under the vehicle body 102. The leveling valve 132 has a rotating lever 134 which is connected to a valving element of the leveling valve 132.

The leveling valve 132 is mounted on the vehicle body side and houses a valving element such as a rotary valve therein. The rotation shaft 136 is integral with the valving element and protrudes outside of a casing of the leveling valve 132. The rotating lever 134 is connected to the rotation shaft. One end of the rotating lever 134 is connected to an adjusting rod 138 and a pin disposed in a vertical direction and the other end thereof is connected to the axle 108. The adjusting rod 138 is configured such that the length thereof can be adjusted by a means such as a turnbuckle.

Moreover, the air spring 106, the leveling valve 132, the adjusting rod 138 and the like are arranged symmetrically about a centerline O.

With the structure above, when the weight of the vehicle body increases due to passengers boarding, the air spring 106 is compressed and the vehicle body 102 lowers and the space between the vehicle body 102 and the bogie 104 becomes smaller. On the other hand, a tip of the rotating lever 134 is connected to the adjusting rod 138 and thus the rotating lever 134 does not move downward but rotate upward about the rotation shaft 136. The rotating lever 134 tilts upward so as to open the leveling valve 132 and then the compressed air is supplied to the air spring 106 via the compressed-air tank 128. In this manner, the vehicle body 102 is lifted. Once the rotating lever 134 becomes horizontal due to the lift of the vehicle body 102, the leveling valve 132 closes and the vehicle body 102 stops lifting.

When the weight of the vehicle body decreases, the vehicle body moves upward and the rotating lever 134 is tilted downward about the rotation shaft 136 so as to open the leveling valve 132 and discharge the compressed air from the air spring 106. In this manner, the vehicle body 102 lowers and the rotating lever 134 becomes horizontal. When the rotating lever becomes horizontal, the leveling valve 132 closes and the vehicle body 102 stops lowering.

This type of the height adjusting mechanism is disclosed in FIG. 6 and FIG. 7 of Patent Document 1 (JP2000-280900) or FIG. 10 of Patent Document 2 (JP2006-62512).

The air springs are arranged on both sides of the vehicle body in the width direction near the axle. The leveling valve is normally provided for each of the air springs in vicinity thereof. The leveling valve is aligned with the air spring in the longitudinal direction of the vehicle so as to make controlling the tilt in the width direction easier.

As described above, the rotating lever 134 tilts and then the leveling valve opens to open the compressed-air supply pipe 130. To take measures against the hunting of the valving element, a dead-band of the tilt amount is provided in the lower limit area. For instance, the dead-band may be 0 mm to ±4 mm at the tip of the rotating lever. Accordingly, the tilt of the vehicle body is tolerated in the range of the dead-band.

In the guideway-type vehicle equipped with the rubber tires, the position of the leveling valve is restricted in a center area of the width direction inside the rubber tires so as not to obstruct the rubber tires. Therefore, the height fluctuation outside of the rubber tires is much greater in the dead-band. Specifically, even when the height fluctuation is 4 mm at the position where the leveling valve is installed, the height fluctuation outside the rubber tires in the width direction may be around 10 mm and exceed the allowable value of the level difference between the vehicle body and a platform.

In the case of the vehicle having the leveling valves on the front bogie and rear bogie, when the tilt of the adjusting valve at the front bogie is opposite to that at the rear bogie in the range of the dead-band, a twisting moment is generated in the vehicle. As for the vehicle of the new transit system whose distance is short between the front and the rear bogies, the vehicle body is tilted to either one of the sides instead of being twisted. This causes an imbalance between the height of the air spring and the pressure of the compressed air. As a result, the relationship of the actual weight of the vehicle body and the pressure of the compressed air inside the air spring becomes imbalanced in some bogies.

This can send a wrong information to a load-compensating device which calculates the weight of the vehicle body from the pressure of the compressed air in the air spring and controls an accelerating force and a break force of the vehicle, resulting in causing negative effects to speed control and stopping accuracy of the vehicle. It is possible to narrow the dead-band of the leveling valve to solve the issue. However, this causes more frequent hunting of the valve and the structure of the leveling valve becomes complex and expensive.

It is also possible to use a shorter rotating lever 134 so as to increase the sensitivity of the rotating lever which moves the adjusting rod 138 in the vertical direction. However, in the case of the vehicle with the rubber tires, the installation location of the leveling valves is restricted to the center area in the width direction as mentioned above and thus the sensitivity cannot be sufficiently improved with respect to the tilt of the vehicle in the width direction thereof. Therefore, this does not solve the issue.

RELATED ART DOCUMENT

[PATENT DOCUMENT 1] JP2000-280900 (FIG. 6 and FIG. 7)

[PATENT DOCUMENT 2] JP2006-62512 (FIG. 10)

SUMMARY OF THE INVENTION

In view of the issues of the related art, an object of the present invention is to perform the height adjustment of the vehicle body with high precision by improving the sensitivity of measuring the height of the vehicle without making the dead-band smaller.

To achieve the above object, the present invention proposes a guideway-type vehicle comprising: a vehicle body; a bolster spring; a bogie which supports the vehicle body via the bolster spring; and a vehicle height adjusting mechanism which includes an integrating device, a measuring device and an elastic force adjusting device, the integrating device integrating a first relative displacement amount at a first position between the vehicle body and the bogie and a second relative displacement amount at a second position between the vehicle body and the bogie, the second position being farther than the first position from the center of the vehicle body in a width direction of the vehicle body, the measuring device measuring an integrated value of the first relative displacement amount and the second relative displacement amount, the elastic force adjusting device adjusting elastic force of the bolster spring based on the integrated value so as to adjust a relative displacement amount between the vehicle body and the bogie.

In the present invention, the integrated value of the first relative displacement amount and the second relative displacement amount is measured and then the elastic force of the bolster spring is adjusted based on the integrated value. Therefore, in comparison to the conventional case, the displacement of the vehicle body is at least doubled, and thus the sensitivity of measuring the height of the vehicle body can be improved. Consequently, the height adjustment of the vehicle body is made easier and with higher precision.

When the vehicle body is tilted in the width direction thereof, a second relative displacement amount at the second position with greater distance from the center of the vehicle body, is greater than a first relative displacement amount at the first position. Thus, the sensitivity of measuring the height of the vehicle body is more than twice as good as the conventional case.

Therefore, according to the present invention, the precision of adjusting the height of the vehicle body is improved and it never exceeds the allowable value of the level difference between the vehicle body and a platform.

Moreover, even when the leveling valve is used, the structure of the valve element of the leveling valve is not changed and thus it is not necessary to change the dead-band. As a result, the hunting of the valve does not take place.

As an example structure of the present invention, the integrating device of the vehicle height adjusting mechanism may be a push-pull cable housed in a cable housing, one end of the push-pull cable being fixed to the vehicle body at the second position and the cable housing is mounted on the bogie in a vertical direction of the first position and the second position, and, the measuring device of the vehicle height adjusting mechanism may include a rotating lever and a measuring part, the rotating lever being connected to the other end of the push-pull cable by means of a pin at the first position and connected to a rotation axis mounted on the vehicle body such that the rotating lever can turn around the rotation axis, the measuring part measuring a turning angle of the rotating lever.

In the first example structure, the second relative displacement amount is transmitted to the other end of the cable at the first position via the cable of the push-pull cable. Therefore, the displacement amount of the other end of the cable at the first position and the turning angle of the rotating lever being connected to the other end of the cable, correspond to the integrated value of the first relative displacement mount and the second relative displacement amount. The turning angle of the rotating lever is set based on the integrated value.

In this manner, the sensitivity of measuring the height of the vehicle body can be improved with a simple and inexpensive means with use of the push-pull cable.

As a second example structure of the present invention, it is preferable that the integrating device of the vehicle height adjusting mechanism includes a rotation fulcrum fixed to the bogie, a lever part being constituted of a first arm and a second arm that are formed integrally with each other and supported rotationally around the rotation fulcrum, and a second connection rod connecting the bogie and the second arm at the second position, and the measuring device of the vehicle height adjusting mechanism includes a rotating lever and a measuring part, the rotating lever being connected to the first arm via a first connection rod by means of a pin at the first position and being rotatable around to the rotation fulcrum, the measuring part measuring a turning angle of the rotating lever.

In the second example structure, the second relative displacement amount at the second position is transmitted to the first arm as a movement of the second arm. By measuring the movement of the first arm, the integrated value of the first and second relative displacement amounts can be measured. And the elastic force of the bolster spring is adjusted based on the integrated value. In this manner, according to the second example structure of the present invention, the sensitivity of measuring the height of the vehicle body can be improved with a simple and inexpensive device.

In the first example structure, it is preferable to adjust the length of the push-pull cable at the second position. By this, it is possible to adjust the length of the push-pull cable at the edge side in the width direction where it is easier to perform the maintenance and thus, the sensitivity of measuring the height of the vehicle body can be adjusted as well.

In the second example structure, it is preferable that a displacement amount of the first connection rod is adjustable by changing a ratio of a first distance between the rotation fulcrum of the first arm and a connection point of the first connection rod and the first arm to a second distance between the rotation fulcrum of the second arm and a connection point of the second connection rod and the second arm.

By this, the sensitivity of measuring the height of the vehicle body is properly adjusted and thus, the sensitivity of measuring the height of the vehicle body can be improved more than twice in comparison to the conventional case.

Further, in the second example structure, it is preferable to adjust a length of the second connection rod. This can change the height position of the first connection rod and the rotating lever. As a result, the sensitivity of measuring the height of the vehicle body is adjusted.

Furthermore, the second connection rod is located at the edge side in the width direction of the vehicle body where the maintenance is easy and thus, the maintenance workers don't need to go under the vehicle body. As a result, the maintenance becomes easy.

According to the present invention, the guideway-type vehicle comprises: a vehicle body; a bolster spring; a bogie which supports the vehicle body via the bolster spring; and a vehicle height adjusting mechanism which includes an integrating device, a measuring device and an elastic force adjusting device, the integrating device integrating a first relative displacement amount at a first position between the vehicle body and the bogie and a second relative displacement amount at a second position between the vehicle body and the bogie, the second position being farther than the first position from the center of the vehicle body in a width direction of the vehicle body, the measuring device measuring an integrated value of the first relative displacement amount and the second relative displacement amount, the elastic force adjusting device adjusting elastic force of the bolster spring based on the integrated value so as to adjust a relative displacement amount between the vehicle body and the bogie, and the elastic force of the bolster spring is adjusted based on the integrated value of the first and second relative displacement amounts. In comparison to the conventional case, the height displacement of the vehicle body is more than doubled at the measuring position and the sensitivity of measuring the height of the vehicle body is enhanced more than twice. As a result, the adjustment of the height of the vehicle body is made easy and with higher precision.

In particular, when the vehicle body is tilted in the width direction thereof, the second relative displacement amount at the second position that has greater distance from the center of the vehicle body than the first position, is integrated with the first relative displacement amount at the first position. In this manner, the sensitivity of measuring the height of the vehicle body can be more than doubled in comparison to the conventional case.

As described above, according to the present invention, the displacement amount between the vehicle body and the platform never exceeds the allowable limit, and when the leveling valve is used, the structure of the leveling valve is not changed and thus it is not necessary to change the dead-band. As a result, the hunting of the valve does not take place.

DETAILED DESCRIPTION OF THE PREFERRED EMBODIMENTS

A preferred embodiment of the present invention will now be described in detail with reference to the accompanying drawings. It is intended, however, that unless particularly specified, dimensions, materials, shape, its relative positions and the like shall be interpreted as illustrative only and not limitative of the scope of the present.

First Preferred Embodiment

Figure 1:
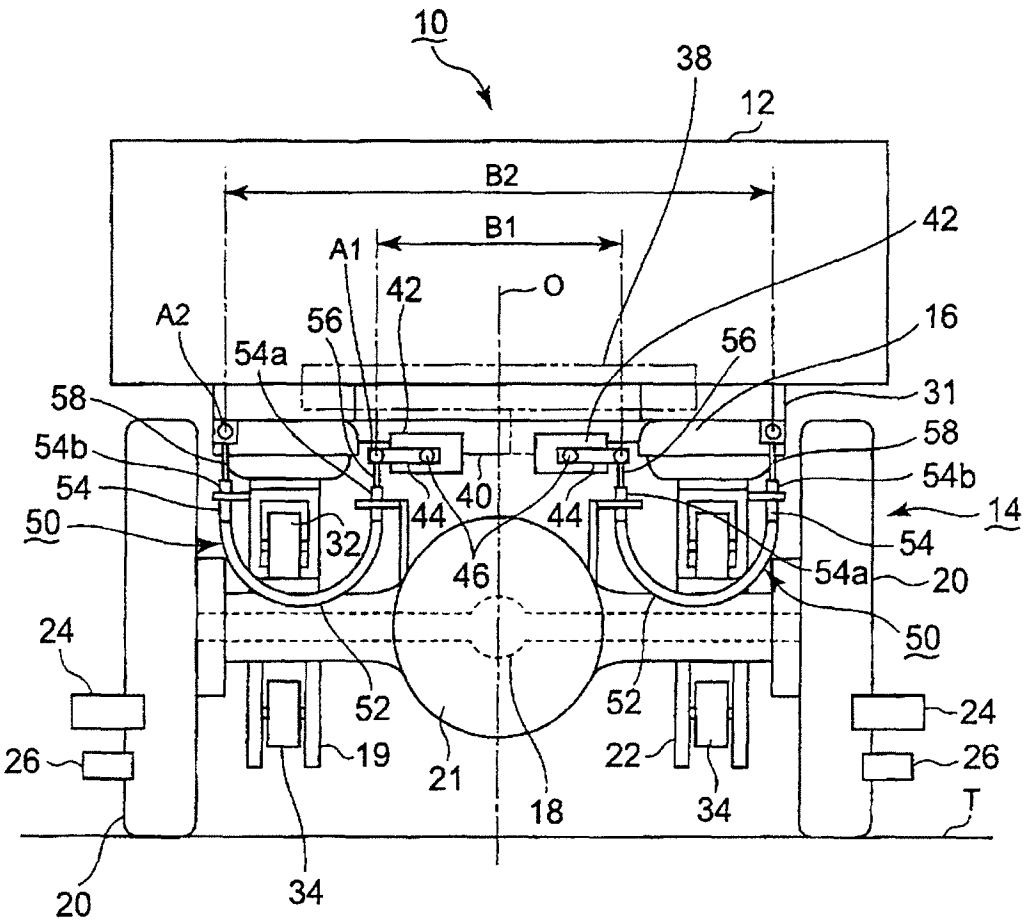
[FIG. 1] A front view of a guide-type vehicle in relation to a first preferred embodiment of the present invention.
Figure 2:
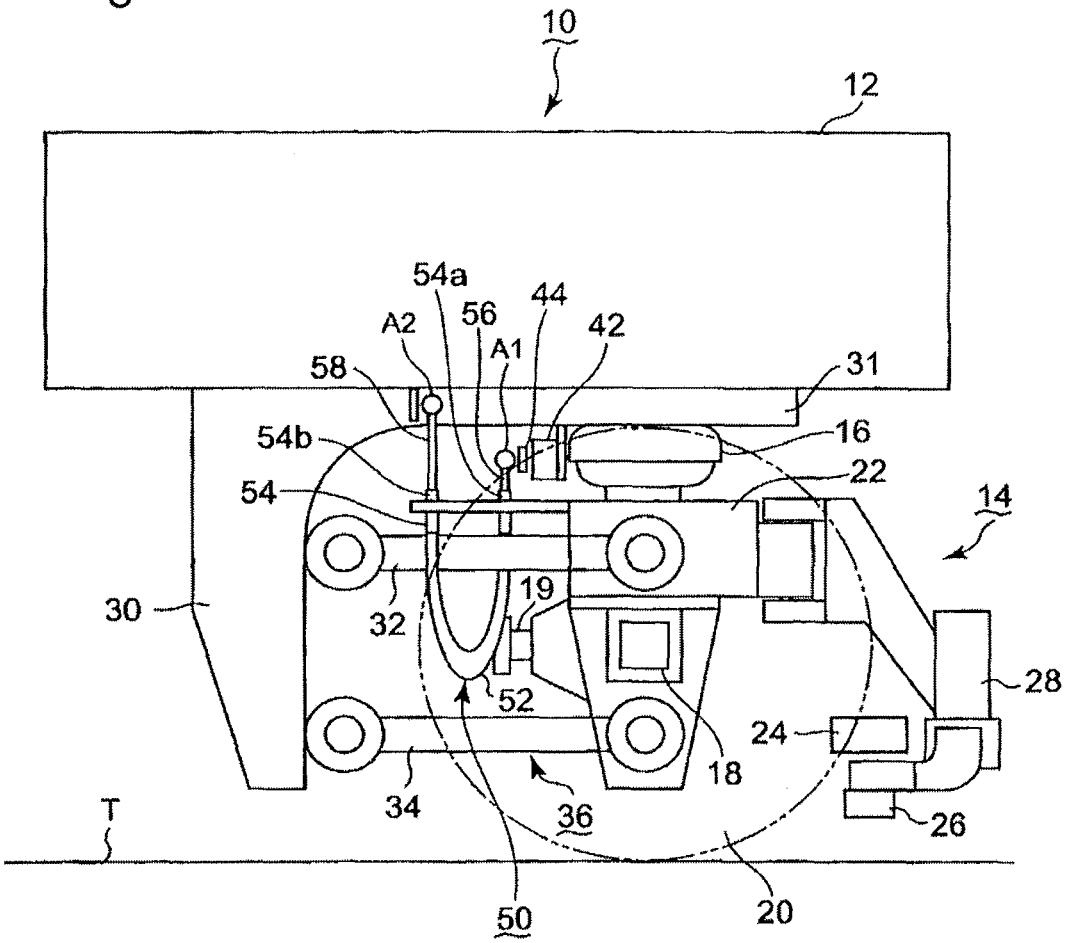
[FIG. 2] A side view of the guide-type vehicle of the first preferred embodiment.

A first preferred embodiment of the present invention is explained hereinafter in reference to FIG. 1 and FIG. 2. In FIG. 1 and FIG. 2, a vehicle 10 of the new transit system has a bogie 14 via air springs 16 mounted under the vehicle body 12. Each of the bogies has one or two air springs 16 mounted in the same position as an axle housing 21 in a longitudinal direction of the vehicle body and symmetrically in a width direction of the vehicle body. An example of the present invention illustrates a case with one air spring.

The bogie 14 comprises an axle housing 21 arranged in the width direction of the vehicle body, an axle 18 housed in the axle housing 21, rubber tires 20 arranged on both sides of the axle 18, an axle frame 22 fixed to the axle housing 21 to support the axle housing 21, and a guide frame 28 mounted on the axle frame 22 and supporting guide wheels 24 and 26 on an edge side of the vehicle body in the width direction. The vehicle 10 travels on a guideway T by the guide wheels 24 and 26 being guided by a guide rail not shown in the drawings.

As shown in FIG. 2, a suspension frame 30 protruding downward is fixed to the vehicle body 12 and four parallel links 32 and 34 are supported pivotally on the suspension frame 30 by one end thereof. A base part 31 is integral with the suspension frame 30 and fixed under the vehicle body 12. The axle frame 22 is fixed to the bogie side 14. The air spring 16 is installed between the base part 31 and the axle frame 22.

The parallel links 32 and 34 are pivotally supported on the axle frame 22 by the other end thereof. The axle housing 21 is supported by a parallel link mechanism 36 formed by the parallel links 32 and 34 such that the axle housing can move in a parallel manner in the vertical direction. In this manner, the height fluctuation of the air spring 16 is tolerated. A propeller shaft 19 is connected to the axle 18 so as to transmit the rotation of a drive motor to the rubber tires 20 via the axle 18.

A compressed-air tank 38 as a supply source of compressed air, a compressed-air supply pipe 40 for supplying the compressed air from the tank 38 to the air spring 16, and a leveling valve 42 installed in the supply 40 are provided under the vehicle body 12.

Figure 5:
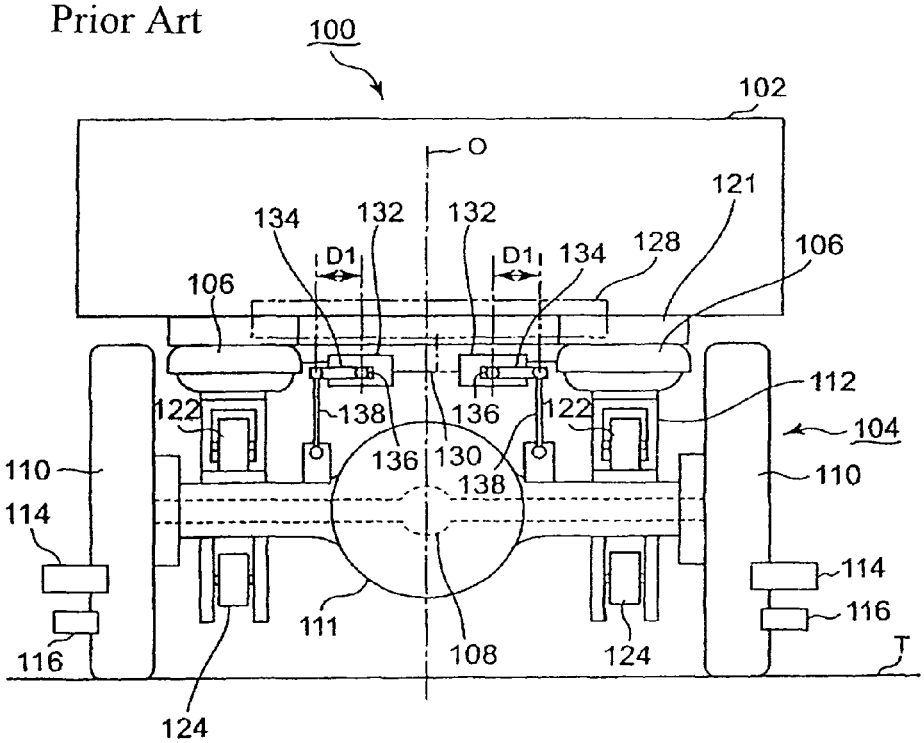
Fig 5 Prior Art
[FIG. 5] A front view of a guide-type vehicle of the related art.
Figure 6:
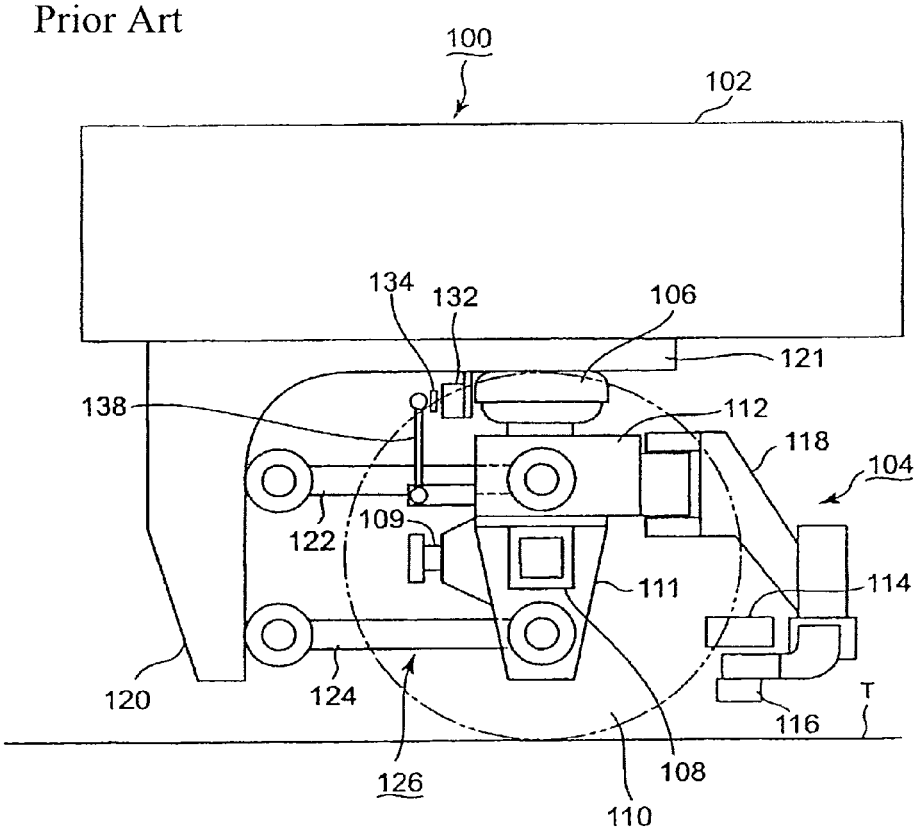
Fig 6 Prior Art
[FIG. 6] A side view of the guide-type vehicle of the related art.

The leveling valve 42 is mounted on the vehicle body side and houses a valving element such as a rotary valve therein. The rotation shaft 46 is integral with the valving element and protrudes outside of a casing of the leveling valve 42. The rotating lever 44 is connected to the rotation shaft 46. The above structure is the same as that of the related art illustrated in FIG. 5 and FIG. 6.

In the preferred embodiment, a push-pull cable 50 is used to measure a relative displacement amount between the vehicle body 12 and the bogie 14. The push-pull cable 50 is constituted of a housing 52 and a cable 54 housed in the housing 52. One end 54*a* of the cable 54 is connected to one end of a rotating lever 44 (an opposite end to the rotation shaft) via a connection rod 56 at a first position $A_1$ in a center area of the width direction of the vehicle body. The other end 54*b* of the cable 54 is connected to abase part 31 via a connection rod 58 at a second position $A_2$ on the edge side of the width direction. The base part 31 is integral with the suspension frame 30 and fixed to the vehicle body 12.

As illustrated in FIG. 2, the first position $A_1$ and the second position $A_2$ are arranged in different places in the longitudinal direction of the vehicle body. The push-pull cable 50 is arranged diagonally to the width direction of the vehicle body. In this manner, the outer end 54*b* of the cable 54 is arranged slightly off the alignment with the rubber tires 20 in the longitudinal direction instead of being arranged on an inner side of the rubber tires 20.

Moreover, as illustrated in FIG. 1, the outer end 54*b* is connected to the base part 31 in the vicinity of the outer edge of the vehicle body 12 and in the same position in the width direction as the outmost edge of the air spring 16.

The length of the cable 54 of the push-pull cable 50 can be adjusted near the second position $A_2$ by a turnbuckle and the like.

With the above structure, when the air spring 16 moves in a vertical direction in response to the weight change of the vehicle body 12, a relative displacement takes place between the vehicle body and the bogie at the first and second positions $A_1$ and $A_2$. This changes the height of the inner end 54*a* of the cable 54 by an integrated amount of a first relative displacement amount at the first position $A_1$ and a second relative displacement amount at the second position $A_2$. Subsequently, the rotating lever 44 rotates around the rotation shaft 46 for the integrated mount and the valving element of the leveling valve 42 rotates in an amount responding to the integrated amount so as to open the leveling valve 42.

When the weight of the vehicle body 12 is reduced and the vehicle body moves upward, the compressed air is discharged from the air spring 16 by the opening/closing operation of the leveling valve 42 and in contrast, when the weight of the vehicle body 12 is increased and the vehicle body moves downward, the compressed air is supplied to the air spring 16 by the opening/closing operation of the leveling valve 42. Once the rotating lever 44 returns to a horizontal position, the leveling valve 42 is closed. In this manner, the height of the vehicle body 12 is adjusted.

When the vehicle body 12 experiences a simple vertical movement, the integrated amount of the relative displacement amounts at the first and second position $A_1$ and $A_2$ between the vehicle body 12 and the bogie 14, is double the relative displacement amount at the first position $A_1$. Thus, the sensitivity of measuring the height of the vehicle body is doubly improved.

When the vehicle body 12 is tilted in the width direction thereof, the vertical movement is greater on the outer side of the vehicle body than the inner side thereof in the width direction. Specifically, the relative displacement value between the vehicle body 12 and the bogie 14 is proportional to the distance from the center O of the vehicle body. Thus, when a distance $B_1$ between the first position and the center O is half of a distance $B_2$ between the second position and the center O, a second relative displacement amount at the second position $A_2$ is twice as much as a first relative displacement amount at the first position $A_1$. The integrated amount of the relative displacement amounts at both positions is twice as much as the relative displacement amount at the first position $A_1$. Consequently, the sensitivity of measuring the height of the vehicle body is improved three times better.

In this manner, according to the preferred embodiment, not only the height adjustment of the vehicle body 12 is made easier but also the precision of the height adjustment is improved and the time for operating the height adjustment is shortened.

Particularly, the sensitivity of measuring the vehicle height when the vehicle body 12 is tilted in the width direction thereof is significantly improved. As a result, the precision of adjusting the height of the vehicle in such case is sufficiently improved, thereby solving the issue of the height difference between the vehicle body 12 and the platform.

Further, the measuring sensitivity to the tilt of the vehicle body 12 is enhanced and thus it is easier to balance the air springs 16 with respect to the tilt of the vehicle body 12. As a result, the height adjustment error of the vehicle body 12 is reduced in response to the weight change of the vehicle body 12.

Furthermore, the structure of the valve element of the leveling valve 42 is not changed and thus the hunting of the valve does not take place. Moreover, in the preferred embodiment, the length of the cable 54 of the push-pull cable 50 can be adjusted to increase the measuring sensitivity and the outer end of the cable 54 is arranged away from the rubber tires 20 instead of on the inner side of the rubber tires and thus, maintenance workers can easily perform such adjustment of the cable length without going under the vehicle body 12.

Second Preferred Embodiment

Figure 3:
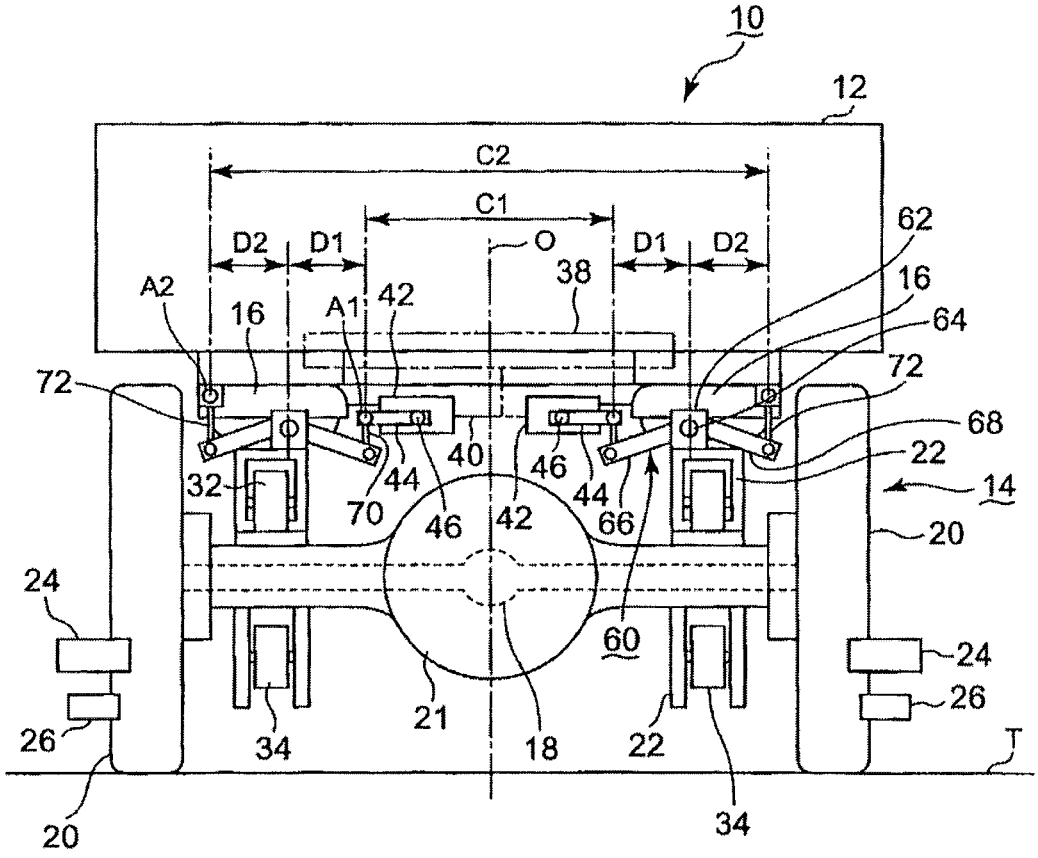
[FIG. 3] A front view of a guide-type vehicle in relation to a second preferred embodiment of the present invention.
Figure 4:
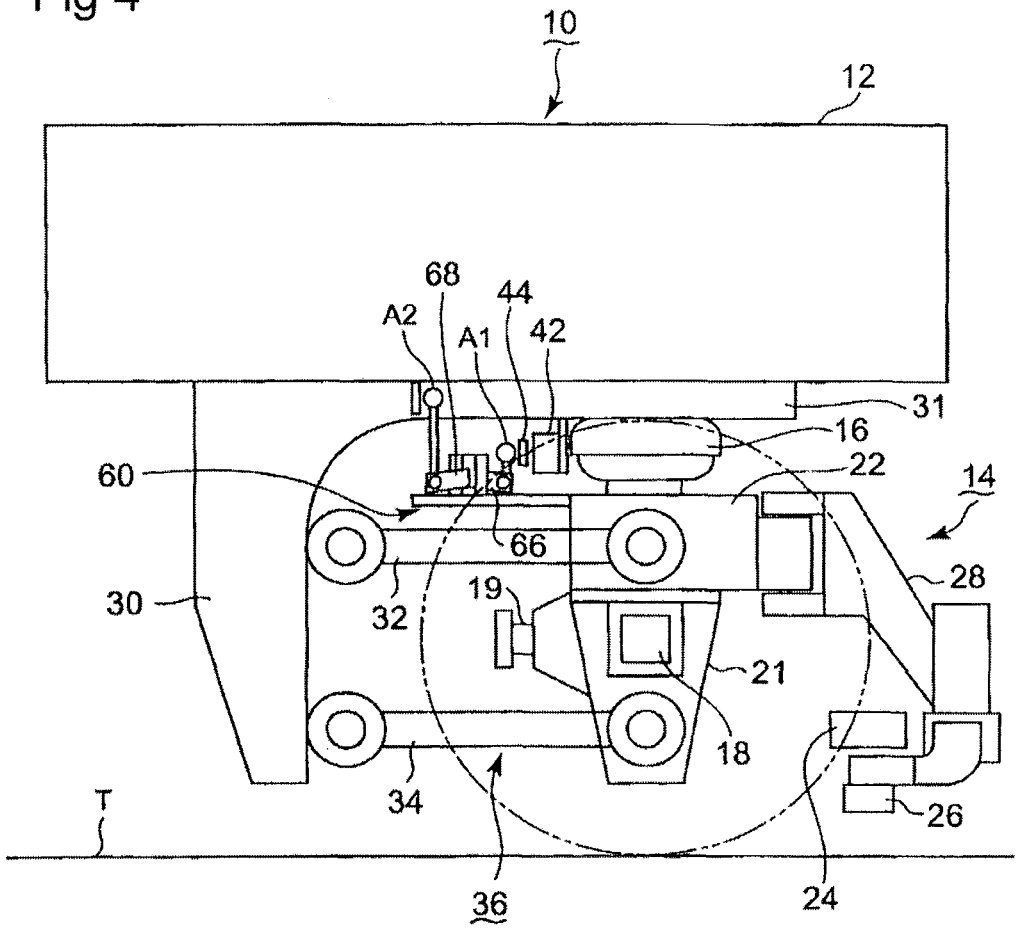
[FIG. 4] A side view of the guide-type vehicle of the second preferred embodiment.

Next, a second preferred embodiment is described in reference to FIG. 3 and FIG. 4. In FIG. 3 and FIG. 4, a lever part 60 is provided to measure the relative displacement amount between the vehicle body 12 and the bogie 14. The lever part 60 comprises a bracket 62 fixed to the axle frame 22 which supports parallel links 32 and 34 rotatably by one end of the links, a first arm 66 and a second arm 68 that are formed integrally with each other and supported rotationally around a rotation axis 64 disposed approximately in the center of the bracket 62.

The first and second arms 66 and 68 are formed integrally on both sides of the rotation axis 64. Each of the arms 66 and 68 has a straight bar shape and forms an angle smaller than 180° opening to the bogie side so as to turn with respect to the rotation axis 64.

A tip of the first arm 66 is connected to one end of the rotating lever 44 via a connection rod 70 on the inner side of the vehicle body in the width direction thereof (the first position $A_1$). A tip of the second arm 68 is connected to the suspension frame 30 via an adjusting rod 72 on the outer side of the vehicle body in the width direction thereof (the second position $A_2$).

As illustrated in FIG. 4, the first position $A_1$ and the second position $A_2$ are not in the same location in the longitudinal direction. Therefore, the lever part 60 is disposed diagonal with respect to the width direction of the vehicle body.

Specifically, the second position $A_2$ is arranged outside of the rubber tire 20 in the longitudinal direction instead of being arranged behind the rubber tire 20. The first and second positions $A_1$ and $A_2$ are arranged in the same manner as those of the first preferred embodiment in the width direction of the vehicle body.

Furthermore, the length of the adjusting rod 72 can be adjusted by a turnbuckle or the like, for instance. The rest of the structure is the same as that of the first preferred embodiment and thus the same components have the same reference numbers as the first preferred embodiment and will not be explained further.

In this preferred embodiment, when the height of the vehicle body 12 changes in the vertical direction due to the weight change of the vehicle body 12, the vertical movement of the tip of the second arm 68 is transmitted to the tip of the first arm 66. Thus, the vertical movement of the tip of the first arm 66 equals to the integrated value of the relative displacement amounts between the vehicle body 12 and the bogie 14 at the first position $A_1$ and the second position $A_2$.

Next, the rotating lever 44 is rotated around the rotation shaft 46 for the amount of the integrated value so as to open the leveling valve 42. In this manner, the compressed air in the amount of the integrated value is supplied to or discharged from the air spring 16. Once the compressed air is supplied to or discharged from the air spring and the vehicle body 12 returns to a prescribed height, the rotating lever 44 return to the horizontal position and the leveling valve 42 is closed.

As described above, according to the preferred embodiment in the manner similar to the first preferred embodiment, when the vehicle body 12 experiences a simple vertical movement, the sensitivity of measuring the height of the vehicle body is doubly improved. Further, when the vehicle body 12 is tilted in the width direction thereof, the vertical movement is greater on the outer side of the vehicle body than the inner side thereof in the width direction. Thus, in the case wherein a distance $C_1$ between the first position and the center O is half of a distance between the second position and the center O, the sensitivity of measuring the height of the vehicle body is improved three times better.

Therefore, the precision of adjusting the height of the vehicle body 12 can be improved and the issue of the relative height difference between the vehicle body 12 and the platform will be solved. Thus, the same function effect as the first preferred embodiment can be obtained.

Further, the sensitivity of measuring the height of the vehicle body in the tilted position can be improved more than three times by making the length $D_2$ of the second arm 68 longer than the length $D_1$ of the first arm, i.e. $D_1<D_2$.

Furthermore, the resistance against the movement of the lever part 60 is only rotational resistance. Thus, the resistance against the movement of the lever part 60 is reduced in comparison with the first preferred embodiment and the sensitivity of measuring the height of the vehicle body can be further enhanced.

It is also possible to adjust the length of the adjusting rod 72 so as to change the height position of the connection rod 70 and the rotating lever 44. As a result, the sensitivity of measuring the height of the vehicle body can be adjusted.

In such case, as shown in FIG. 4, the adjusting rod 72 is arranged outside of the rubber tires 20 in the longitudinal direction instead of the inner side of the rubber tires 20 and also in the vicinity of the outer edge of the vehicle body in the width direction. Therefore, maintenance workers can easily perform an adjustment without going under the vehicle body 12.

Moreover, in the first and second preferred embodiments, the sensitivity of measuring the height of the vehicle body can be improved by simply making the distance shorter between the rotation shaft 46 and the connection rod 66 or 60 in the rotating lever 44.

INDUSTRIAL APPLICABILITIES

According to the present invention, in a guideway-type vehicle such as a new transit system, the sensitivity of measuring the relative displacement amount between the vehicle body and the bogie due to the weight change of the vehicle body can be improved with a simple and inexpensive device, thereby making the height adjustment of the vehicle body easy, improving the precision of the height adjustment and diminishing the height error between the vehicle body and the platform.

The invention claimed is:

1. A vehicle comprising:

a vehicle body;

a bolster spring;

a bogie which supports the vehicle body via the bolster spring; and a vehicle height adjusting mechanism which includes an integrating device, a measuring device and an elastic force adjusting device, the integrating device integrating a first relative displacement amount at a first position between the vehicle body and the bogie and a second relative displacement amount at a second position between the vehicle body and the bogie, the second position being farther than the first position from a center of the vehicle body in a width direction of the vehicle body, the measuring device measuring an integrated value of the first relative displacement amount and the second relative displacement amount, the elastic force adjusting device adjusting elastic force of the bolster spring based on the integrated value so as to adjust a relative displacement amount between the vehicle body and the bogie, wherein the integrating device of the vehicle height adjusting mechanism is a push-pull cable housed in a cable housing, one end of the push-pull cable being fixed to the vehicle body at the second position and the cable housing is mounted on the bogie in a vertical direction of the first position and the second position, and wherein the measuring device of the vehicle height adjusting mechanism includes a rotating lever and a measuring part, the rotating lever being connected to the other end of the push-pull cable by means of a pin at the first position and connected to a rotation axis mounted on the vehicle body such that the rotating lever can turn around the rotation axis, the measuring part measuring a turning angle of the rotating lever.

2. The vehicle according to claim 1, wherein the bolster spring is an air spring, and the elastic force adjusting device includes a compressed air tank storing compressed air, a compressed air supply pipe connected to the compressed air tank and the air spring, and a leveling valve installed in the compressed air supply pipe, and wherein the elastic force-adjusting device adjusts a valve opening amount of the leveling valve based on the integrated value.

3. The vehicle according to claim 1, wherein a length of the push-pull cable can be adjusted at the second position.

4. A vehicle comprising:

a vehicle body;

a bolster spring;

a bogie which supports the vehicle body via the bolster spring; and a vehicle height adjusting mechanism which includes an integrating device, a measuring device and an elastic force adjusting device, the integrating device integrating a first relative displacement amount at a first position between the vehicle body and the bogie and a second relative displacement amount at a second position between the vehicle body and the bogie, the second position being farther than the first position from the center of the vehicle body in a width direction of the vehicle body, the measuring device measuring an integrated value of the first relative displacement amount and the second relative displacement amount, the elastic force adjusting device adjusting elastic force of the bolster spring based on the integrated value so as to adjust a relative displacement amount between the vehicle body and the bogie, wherein the integrating device of the vehicle height adjusting mechanism includes a rotation fulcrum fixed to the bogie, a lever part having a first arm and a second arm that are formed integrally with each other and supported rotationally around the rotation fulcrum, a first connection rod connecting the measuring device and the first arm, and a second connection rod connecting the vehicle body and the second arm at the second position, wherein the first position and the second position are not in a same position in a longitudinal direction of the vehicle body, wherein the lever part is disposed diagonal with respect to a width direction of the vehicle body, and wherein the measuring device of the vehicle height adjusting mechanism includes a rotating lever and a measuring part, the rotating lever being connected to the first arm via the first connection rod by means of a pin at the first position and being rotatable around to the rotation fulcrum, the measuring part measuring a turning angle of the rotating lever.

5. The vehicle according to claim 4, wherein a displacement amount of the first connection rod is adjustable by changing a ratio of a first distance between the rotation fulcrum of the first arm and a connection point of the first connection rod and the first arm to a second distance between the rotation fulcrum of the second arm and a connection point of the second connection rod and the second arm.

6. The vehicle according to claim 4, wherein a length of the second connection rod can be adjusted.

7. The vehicle according to claim 4, wherein the first arm and the second arm extend from a connecting portion corresponding to the rotation fulcrum in a direction opposite to each other with respect to a width direction of the vehicle body, and an angle formed between the first arm and the second arm is smaller than 180 degree relative to a bogie side.

8. The vehicle according to claim 4, wherein the first connection rod and the second connection rod extend vertically from the lever part to be parallel to each other.

* * * * *